US006041479A

United States Patent [19]

Colpo

[11] Patent Number: 6,041,479

[45] Date of Patent: Mar. 28, 2000

[54] CLASP WITH PROTRUDING ELEMENT FOR JEWELRY ITEMS

[75] Inventor: Renzo Colpo, Sovizzo, Italy

[73] Assignee: Colpo & Zilio Srl, Torri di Quartesolo, Italy

[21] Appl. No.: 09/090,346

[22] Filed: Jun. 4, 1998

[30] Foreign Application Priority Data

Jun. 10, 1997 [IT] Italy ..... VI97A0090

[51] Int. Cl.[7] ..... A44B 11/26

[52] U.S. Cl. ..... 24/606; 24/611

[58] Field of Search ..... 24/606–611; 411/340–344

[56] References Cited

U.S. PATENT DOCUMENTS

| | | | |
|---|---|---|---|
| 233,281 | 10/1880 | Reinhold et al. | 411/342 |
| 407,227 | 7/1889 | May | 24/611 X |
| 874,957 | 12/1907 | Godley | 24/625 X |
| 1,199,014 | 9/1916 | Ludeke et al. | 24/611 |
| 1,382,256 | 6/1921 | Tomchin | 24/611 X |
| 1,945,266 | 1/1934 | Einsele | 24/68 J |

*Primary Examiner*—James R. Brittain

*Attorney, Agent, or Firm*—Watson Cole Grindle Watson, P.L.L.C.

[57] ABSTRACT

The invention is a clasp for jewellery items comprising a female element suitable for housing a protruding element belonging to a male element. Said protruding element is provided with a pair of coupling elements, each one positioned at one end of a pair of shaped rods cooperating with operating means suitable for achieving the caliper-like movement of said rods around a pin that connects them to each other and to the body of said male element in order to obtain the connection or the disconnection of said coupling elements to or from corresponding check elements belonging to said female element.

13 Claims, 6 Drawing Sheets

CLASP WITH PROTRUDING ELEMENT FOR JEWELRY ITEMS

BACKGROUND OF THE INVENTION

The invention concerns a clasp with protruding element for jewellery items, such as bracelets, straps, necklaces and alike, particularly suitable for application on watch bracelets. It is known that to wear watches on the wrist bracelets and straps made of gold and other precious alloys are used, the ends of which are reciprocally connected by means of appropriate clasps.

The clasps that are applied to said bracelets or straps must ensure proper fastening, but above all they must ensure easy opening and clasping, considering that the person carrying out these operations can use one hand only.

The clasp object of the present invention aims at achieving these purposes.

SUMMARY OF THE INVENTION

In particular, one of the goals of the invention is the implementation of a clasp that should ensure the stable connection of the strap or bracelet ends and prevent any accidental opening.

Another aim of the invention is the implementation of a clasp that should be easy to open and fasten with one hand only, so that the watch can be comfortably put on and taken off.

The above mentioned goals are achieved through the implementation of a clasp for jewellery items, such as watch straps, bracelets, necklaces and similar ornamental items, which, according to the main claim, comprises a female element provided with first means for the connection to one end of one of said ornamental items and with a hole suitable for housing a protruding element belonging to a male element provided with second connection means for the connection to the other end of the same ornamental item, and wherein said protruding element is provided with a pair of radially protruding coupling elements, each one of which is positioned at one end of a pair of shaped rods cooperating with operating means suitable for achieving the caliper-like movement of said rods around a pin by means of which they are rotatingly connected to each other and to the body of said male element, said caliper-like movement being suitable for achieving the connection or the disconnection of said coupling elements to/from corresponding check elements belonging to said female element when said protruding element is connected or disconnected in or from said hole provided in said female element.

According to a possible application of the invention, said operating means suitable for achieving the caliper-like movement of said shaped rods comprise a pair of pin buttons protruding from the body of said male element, which are operated through the pressured exerted by two opposite fingers, in such a way as to push the coupling elements within the outline of the body of the protruding element and to separate the male element from the female element and unfasten the clasp.

The operating means that, instead, intervene after the male element and the female element have been coupled, comprise a cylindrical spring interposed between said shaped rods beyond the reciprocal hinging point; the thrusting force of the spring, after the insertion of the protruding element into the hole of the female element, achieves the fixing of the coupling elements in the check elements provided in the female element, in such a way as to ensure the proper fastening of the clasp.

As an alternative, the cylindrical spring can be replaced with a cylindrical spring with protruding ends, positioned coaxially to the connection pin between the shaped rods.

To advantage, the clasp object of the invention is easy to use and can be fastened or opened through the opposing pressure exerted by two fingers, which makes it easier and quicker to put on and take off the bracelet.

BRIEF DESCRIPTION OF THE INVENTION

The above mentioned goals and advantages will be better highlighted in the description of a favourite application of the invention in question, illustrated in the attached drawings, wherein.

DESCRIPTION OF THE INVENTION

Figure 1:
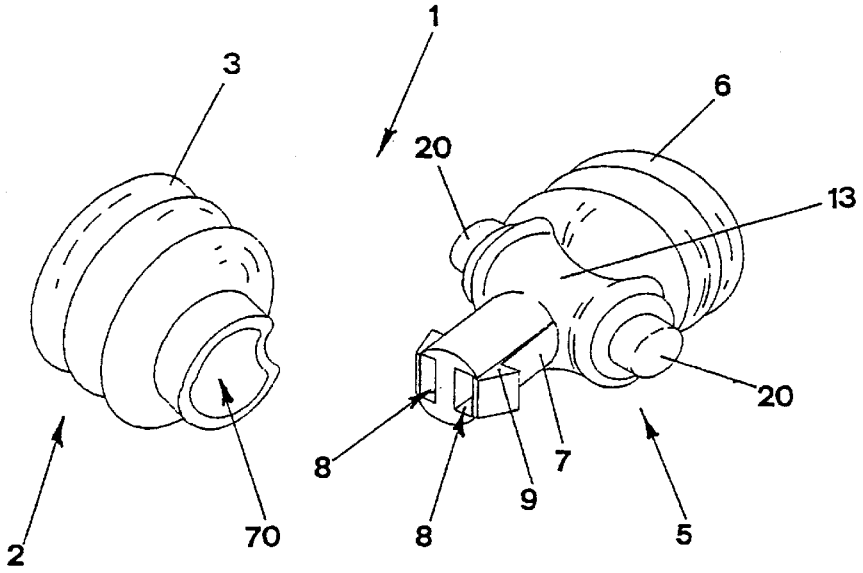
FIG. 1 is an axonometric view of the clasp object of the invention with the male and female elements that make it up disconnected.

As shown in FIG. 1, the clasp object of the invention, indicated as a whole by 1, comprises a female element, indicated as a whole by 2, provided with first connection means 3 at one end (not represented) of an ornamental item, for example a bracelet or a necklace, and a male element, indicated as a whole by 5, provided with second connection means 6 at the other end (not represented) of the same ornamental item.

Said male element, as shown in detail in FIGS. 5 to 8, comprises a substantially cylindrical protruding element 7, provided with two slots 8, through each one of which a coupling element 9 protrudes, said coupling element being suitable for fitting into a corresponding check element 71 provided inside said female element 2.

In particular, it can be observed that each coupling element belongs to a shaped rod 12 and said shaped rods are rotatingly connected to each other and to the body 13 of said male element by means of a pin 14.

Figure 2:
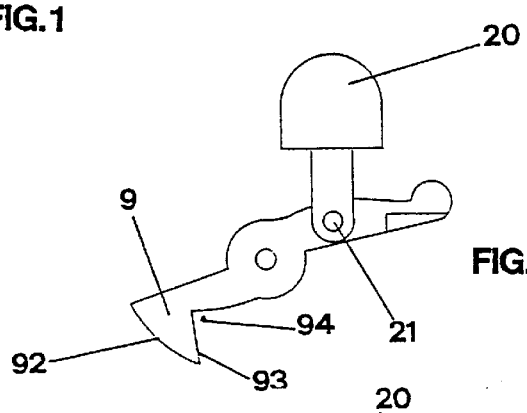
FIGS. 2 and 3 are front views of the two shaped rods that make up the clasp object of the invention, each one provided with the relevant operating pin.
Figure 3:
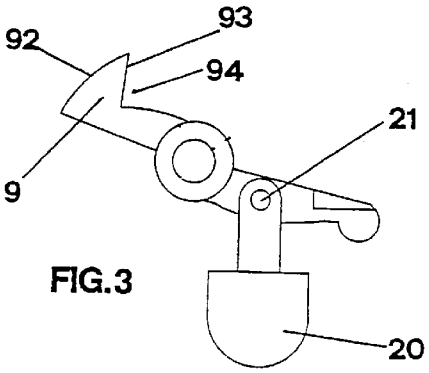
Figure 4:
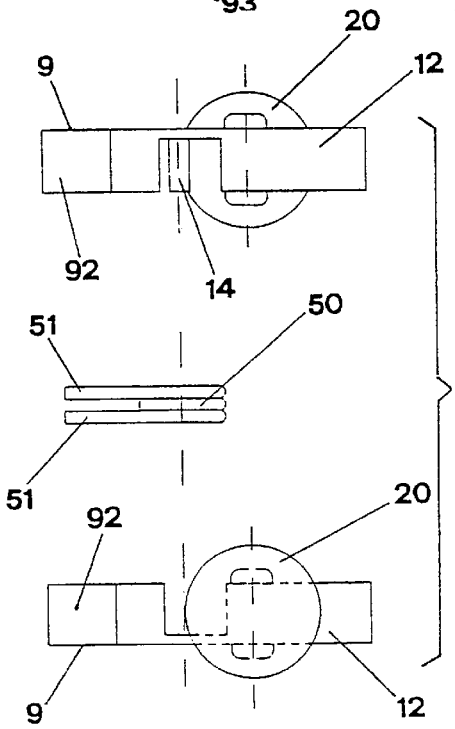
FIG. 4 is a side view of the two shaped rods of FIGS. 2 and 3, with the interposed spring that makes them reciprocally elastic.

Furthermore, as shown in detail in FIGS. 2 to 4, said shaped rods are provided with operating means that comprise:

a pair of pin buttons 20, protruding from the body of said male element, each one of which is rotatingly hinged to a corresponding shaped rod by means of a pin 21, in intermediate position with respect to the shaped rod, between the pin connecting said rods with each other and the end opposite the end where said coupling elements are provided;

a cylindrical spring 50 interposed between said shaped rods and coaxial to said pin, whose ends rest against each one of said rods.

Figure 9:
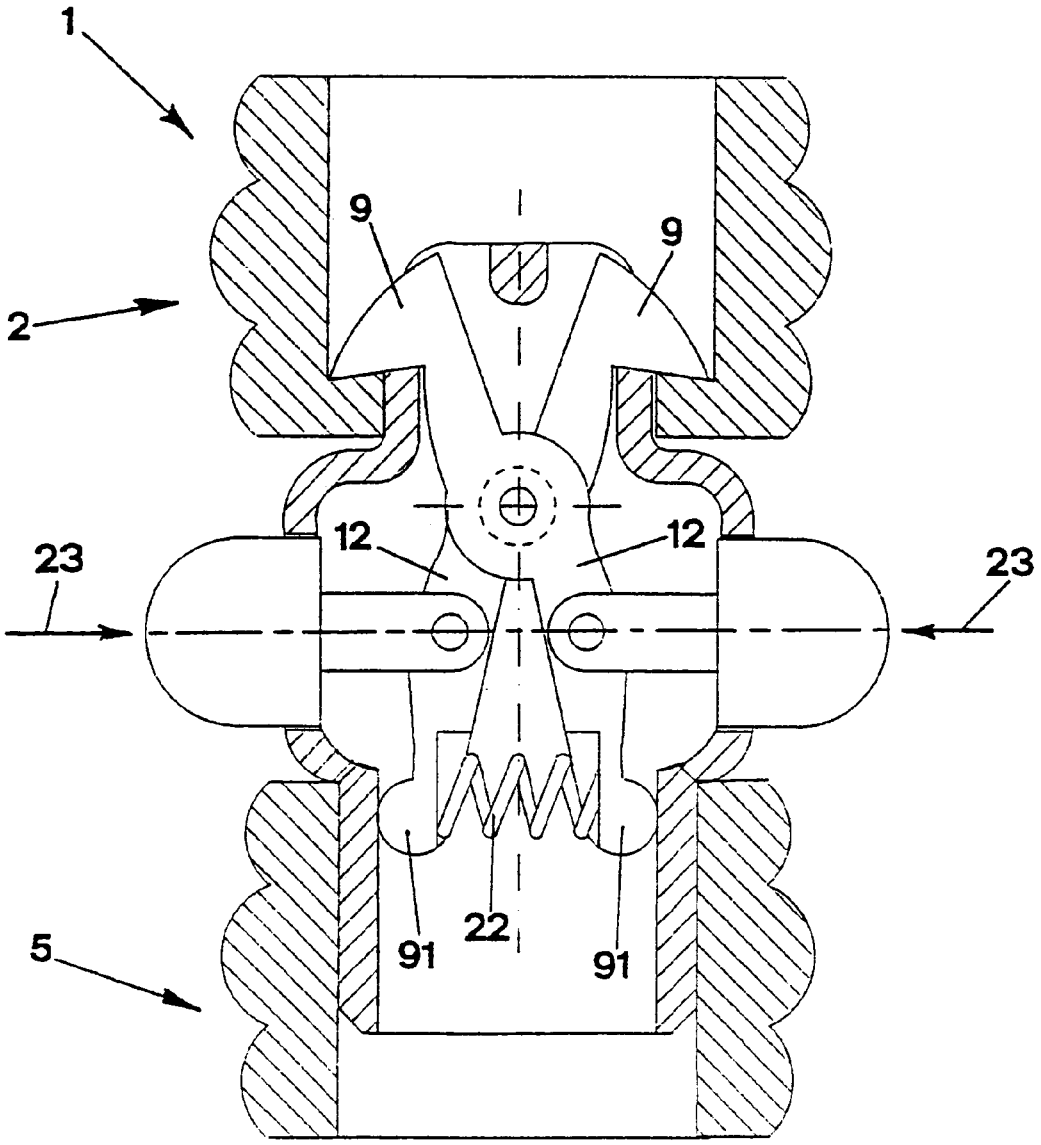
FIG. 9 shows a longitudinal section of a variant of the clasp object of the invention.

As an alternative to the use of the cylindrical spring positioned coaxially to said pin, according to a different application of the invention represented in FIG. 9, a cylindrical spring having the same effect as the spring 22 can be interposed between the ends of said shaped rods arranged opposite the end where said coupling elements are provided. In both the above mentioned applications, the two shaped rods can reciprocally rotate according to a caliper-like movement around the pin when they are subjected to the action of said operating means. More particularly, when said pin buttons are pressed by means of two opposite forces, they get within the outline of the body of the male element and make the shaped rods rotate like a caliper; in turn, the shaped rods push the coupling elements within the outline of the body of the protruding element.

At the same time, the approach of the pin buttons produces tension on the spring, so that when the action exerted by the opposite forces on said pin buttons stops, the elastic recovery of the cylindrical spring causes again the caliper-like rotation of said shaped rods around the same pin, which once again makes the coupling elements protrude through the slots of the protruding element.

Thanks to the presence of the pins connecting each sliding pin to the corresponding shaped rod, said pin buttons get in the body of the male element keeping their axis 210 substantially orthogonal to the longitudinal axis 30 of the clasp, in such a way as not to interfere with the body of the said male element.

Figure 6:
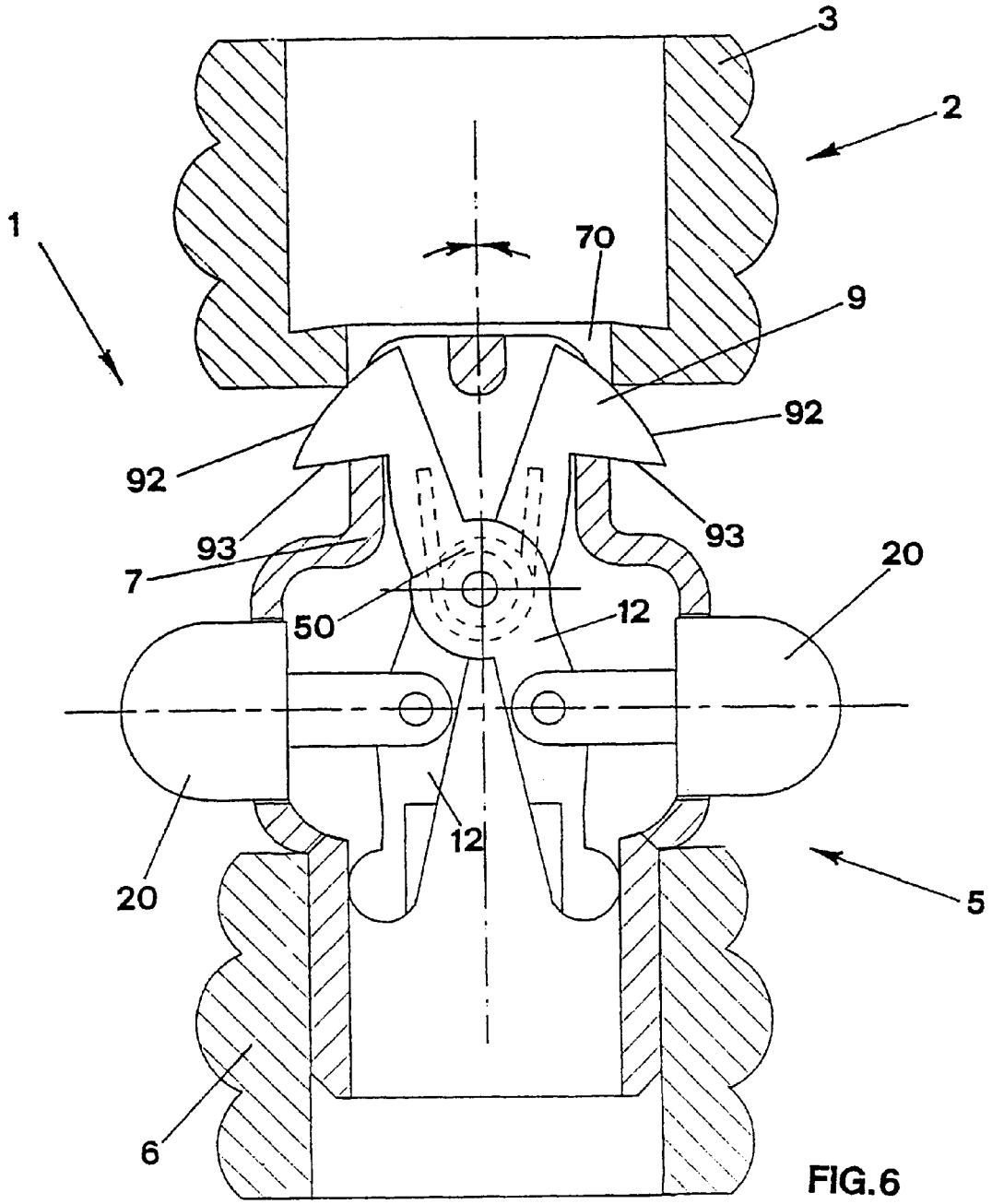
FIG. 6 shows a longitudinal section of the male and female elements that make up the clasp object of the invention at the beginning of the coupling phase.

As far as each coupling element is concerned, it can be observed that it substantially comprises a tooth shaped like an asymmetrical spire defined by two sides:

a front side 92 shaped with convex profile that, as shown in FIG. 6, during the coupling of the elements constituting the clasp rests against the female element and causes the caliper-like rotation of both the shaped rods, thus making the coupling elements get into the slots to ensure the insertion of the protruding element into the hole 20 of the female element;

a rear side 93 that, together with the body of said shaped rod, defines an undercut area 94 suitable for housing one of the check elements of said female element in order to prevent the separation of the male and female elements, 5 and 2 respectively, after the coupling has taken place.

As far as said check elements are concerned, it can be observed that each one of them is constituted by a radial protrusion having a triangular profile with acute angle 100 directed towards the inside of the female element and defined by the side surface of said hole 70 provided in the said female element and by a second side 101 that is inclined with respect to said side surface of said hole.

In a different, not represented application of the invention, said check elements, which in the application described herein are two, each one positioned in correspondence with a coupling element , can be continuous, in fact they can be constituted by an annular area with acute angle directed towards the inside of the female element.

Figure 5:
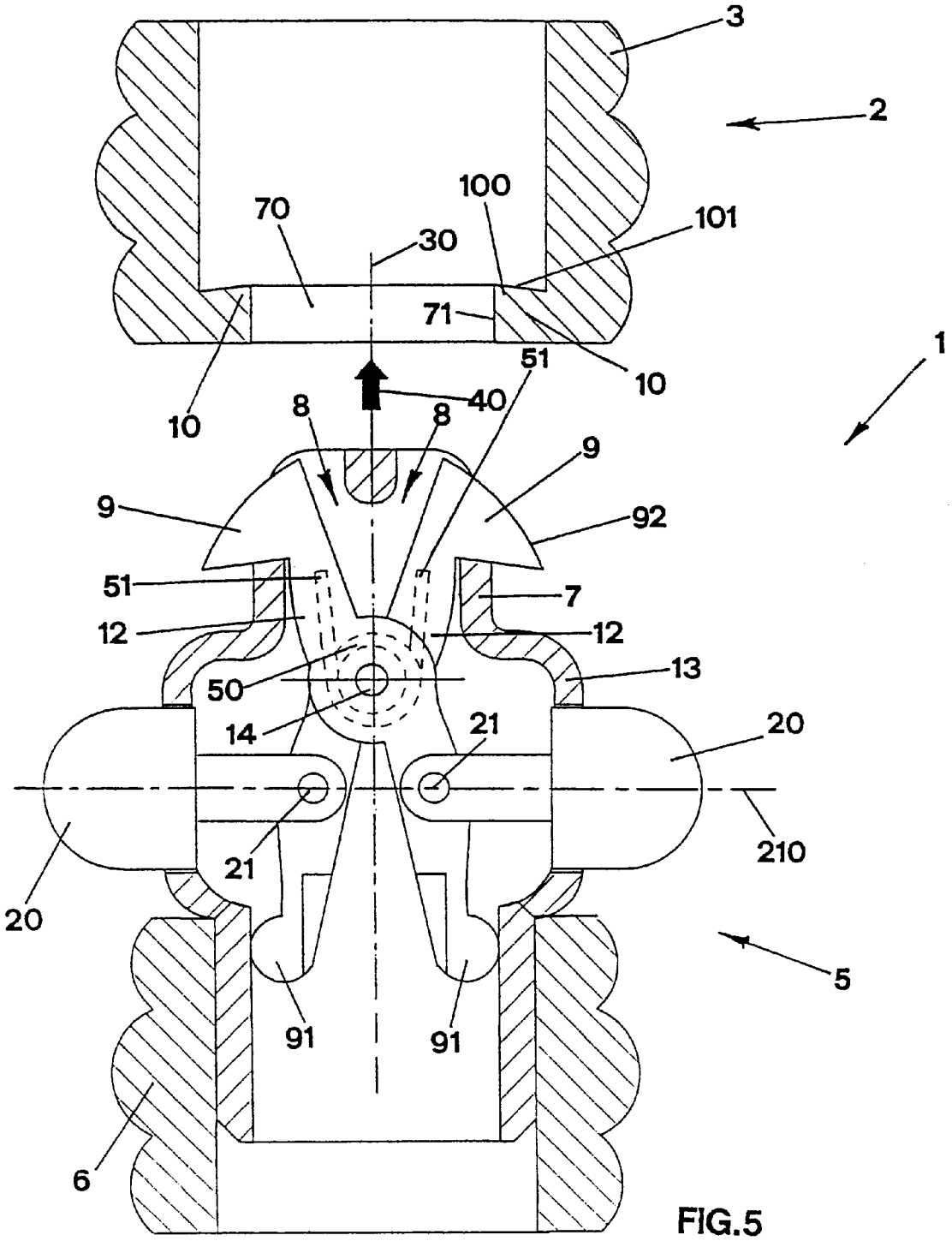
FIG. 5 shows a longitudinal section of the male and female elements that make up the clasp disconnected.
Figure 7:
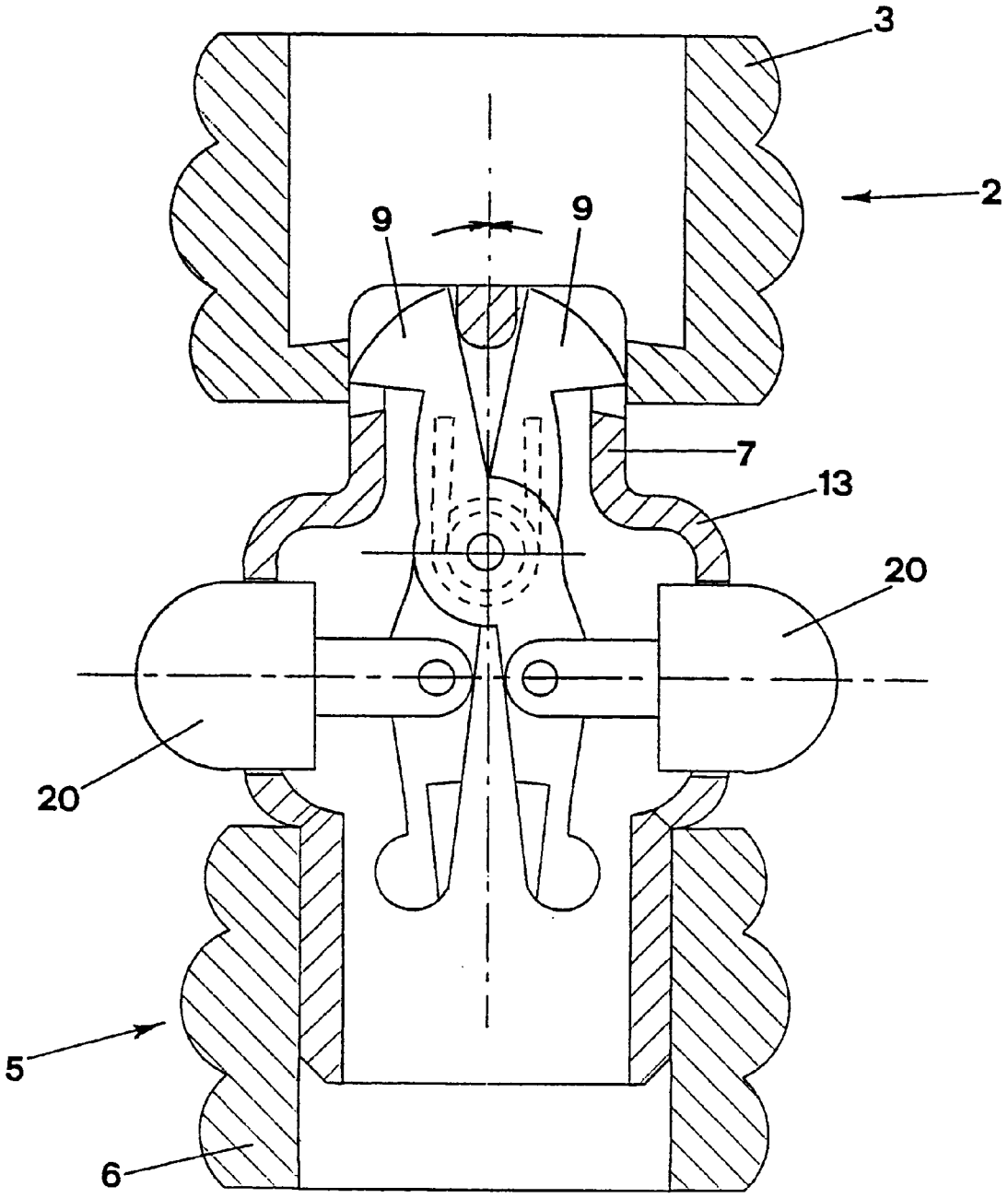
FIG. 7 shows a longitudinal section of the male and female elements that make up the clasp object of the invention during the coupling phase.
Figure 8:
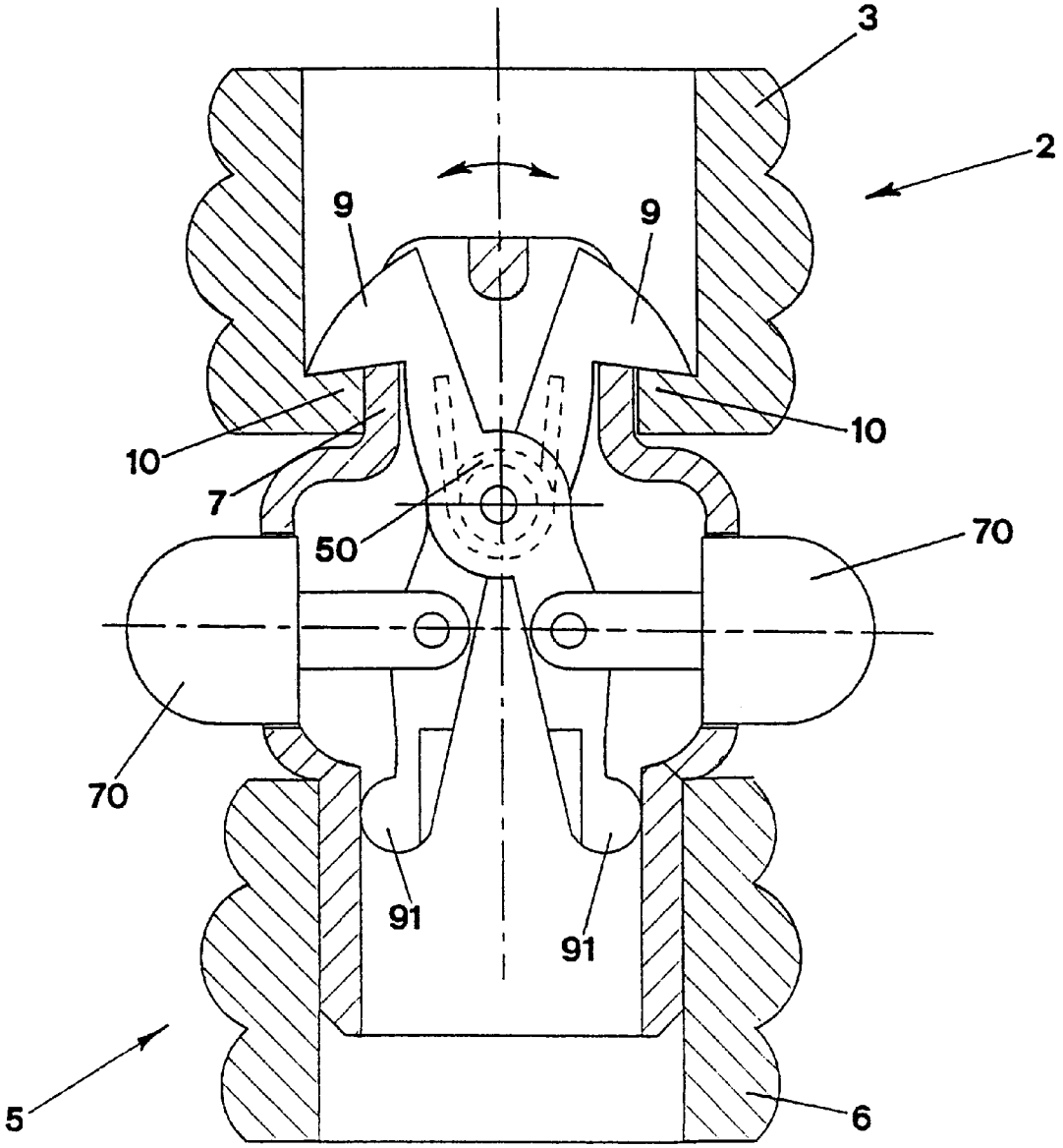
FIG. 8 shows a longitudinal section of the male and female elements that make up the clasp object of the invention after the coupling.

Starting from the situation in which the clasp is open, that is, with the male and female elements that make it up separated from each other, as shown in FIG. 5, the male element is forced against the female element with an axial movement according to the direction 40, so that, as already explained, the convex profile of the front side 92 of each coupling element causes the rotation of the shaped rods around the pin and the coupling elements are pressed within the outline of the protruding element, which, as shown in FIG. 7, is slided into the hole of the female element.

After the coupling has taken place, the elastic recovery of the cylindrical spring 50 or 22—according to the chosen application—which had previously been compressed, makes the coupling elements protrude from the slots again and fit into the check elements, thus keeping the male and female elements stably connected and fastening the clasp.

As an alternative, the coupling of the male element with the female element can be achieved by pushing the coupling elements within the outline of the protruding element through the application of opposite pressures on the pin buttons with two fingers.

To open the clasp and separate the male and female elements that make it up, it is sufficient to apply a pressure 23 in opposite directions to the pin buttons, in such a way as to produce again the caliper-like rotation of the shaped rods and push the coupling elements within the outline of the protruding element, thus releasing them from the check elements. The protruding element can thus be withdrawn from the hole by separating the male and female elements through a relative axial shift of the male element or of the female element.

According to the above description, the clasp object of the invention achieves the set goals.

In particular, the invention achieves the goal to implement a particularly safe clasp, since, as already explained, to separate the elements that make it up it is necessary to apply a pressure in opposite directions 25 onto the pin buttons of the male element and at the same time to reciprocally separate the male element and the female element.

It has also been demonstrated that the clasp object of the invention is particularly suitable for application on bracelets, in particular watch bracelets, since its opening and fastening can be obtained by using the fingers of one hand only.

Obviously, the clasp can have any shape and size, and likewise the elements that make it up can have any profile, size and shape.

Any variant of the clasp is to be considered as protected by the present invention, provided that it is based on the same innovative concept described herein.

I claim:

1. A clasp for jewelry items like straps, bracelets, necklaces and similar ornamental items having ends, comprising:

a female element including first means for the connection to one end of one of said ornamental items and having a hole with check elements; and a male element including a protruding element for engaging the hole, said male element for connection to the other end of the same ornamental item, and wherein said protruding element includes shaped rods having a pair of radially protruding coupling elements, each one of which being positioned at one end of each of said pair of shaped rods; a pin for hinging the rods at a point; operating means cooperating with the shaped rods for achieving caliper-like movement of said rods around the pin by means of which said rods are rotatingly connected to each other and to the male element, said caliper-like movement for achieving connection and disconnection of said coupling elements with the corresponding check elements of said female element when said protruding element is connected and disconnected with said hole in said female element, and wherein said operating means comprises, a pair of pin buttons protruding from the male element, each one of which being rotatingly hinged by means of pins to the corresponding shaped rod beyond the hinging point of the rods and near an end opposite the end where said coupling elements are provided.

2. The clasp according to claim 1, wherein said protruding element comprises a substantially cylindrical area of said male element slidable into said hole in said female element and from which said coupling elements protrude, wherein said coupling elements are positioned at ends of said shaped rods for coupling with said check elements of said female element.

3. The clasp according to claim 1, wherein each coupling element comprises a tooth shaped like an asymmetrical spire defined by two sides a front side shaped with a convex profile for resting against the female element when coupled and for causing caliper-like rotation of both the shaped rods when said protruding element is inserted in said hole of said female element; a rear side that, together said shaped rod defining an undercut area for housing one of said check elements of said female element to prevent separation of said elements after the coupling.

4. The clasp according to claim 1, wherein said check elements comprise radial protrusions inside said female element and having a triangular profile with an acute angle directed towards the inside of the female element, said acute angle being defined by an intersection between a side surface of said hole in said female element and a second side inclined with respect to said side surface.

5. The clasp according to claim 1, wherein said operating means comprises at least one cylindrical spring interposed between said shaped rods beyond the hinging point in correspondence with the ends opposite the ends where said coupling means are provided.

6. The clasp according to claim 1, wherein said operating means comprises at least one cylindrical spring with protruding ends, each one of which cooperates with one of said shaped rods and positioned externally and coaxially to said pin, by means of which said rods are connected to each other and to said male element.

7. A clasp for jewelry items having first and second ends comprising:

a female element including first means for connection to the first end of the jewelry item and having a hole formed with check elements; and a male element for connection to the second end of the jewelry item including a protruding element for engaging the hole, said protruding element including a pair of shaped rods each having a first end and a second end, said second end formed with a radially protruding coupling element; a pin for hinging the rods to the male element at a pivot point; manually operable operating means secured to the shaped rods for rotating each of said rods around the pin for effecting connection and disconnection of said coupling elements with the corresponding check elements of said female element when said protruding element is inserted into said hole, and wherein said operating means comprises, a pair of pin buttons protruding from the male element, each being rotatingly hinged to the corresponding shaped rod at a point remote from the first end beyond the pivot point of the rods and near the second end.

8. The clasp according to claim 7, Wherein said protruding element comprises a cylindrical member slidable into said hole from which said coupling elements protrude.

9. The clasp according to claim 7, wherein each coupling element comprises a tooth shaped asymmetrical member having, a front side shaped with a convex profile for resting against the female element and for causing rotation of the shaped rods when said protruding element is inserted in said hole; a rear side defining an undercut area for engaging a corresponding one of said check elements.

10. The clasp according to claim 7, wherein said check elements comprise radial portions within said female element having a triangular profile with an acute angle directed inwardly of the female element.

11. The clasp according to claim 10, wherein the acute angle is defined by an intersection between a side surface of said hole in said female element and a second side inclined with respect to said side surface.

12. The clasp according to claim 7, Wherein said operating means comprises at least one cylindrical spring interposed between said shaped rods near the operating means.

13. The clasp according to claim 7, wherein said operating means comprises at least one cylindrical spring having protruding ends, each one of which cooperates with a corresponding one of said shaped rods and being positioned externally and coaxially with said pin.

* * * * *